US006378236B1

(12) United States Patent
Solberg et al.

(10) Patent No.: US 6,378,236 B1
(45) Date of Patent: Apr. 30, 2002

(54) CLEANER FOR ELONGATE BORES

(76) Inventors: Douglas G. Solberg, 528 6th St., Juneau, AK (US) 99801; Clifton G. Orcutt, 14411 Madison Ave., NE., Bainbridge Island, WA (US) 98110

( * ) Notice: Subject to any disclaimer, the term of this patent is extended or adjusted under 35 U.S.C. 154(b) by 0 days.

(21) Appl. No.: 09/436,659

(22) Filed: Nov. 10, 1999

(51) Int. Cl.[7] ..... F41C 27/00

(52) U.S. Cl. ..... 42/95; 15/104.165; 15/104.2; 15/104.9

(58) Field of Search ..... 42/95; 15/104.9, 15/104.05, 104.2, 104.165

(56) References Cited

U.S. PATENT DOCUMENTS

| | | | | | |
|---|---|---|---|---|---|
| 681,163 | A | | 8/1901 | Woodman | |
| 1,552,994 | A | * | 9/1925 | Lindeman | 15/104.165 |
| 1,978,853 | A | * | 10/1934 | Albright | 15/104.9 |
| 2,824,322 | A | | 2/1958 | Angelica et al. | |
| 2,897,525 | A | | 8/1959 | Goodwin et al. | |
| 3,814,525 | A | | 6/1974 | Spencer | |
| 4,222,142 | A | | 9/1980 | DiProspero | 15/104.165 |
| 4,674,218 | A | | 6/1987 | Bottomley | 42/95 |
| 4,690,824 | A | | 9/1987 | Lieptz | 42/95 |
| 4,858,360 | A | | 8/1989 | Hardin | 42/95 |
| 4,930,240 | A | | 6/1990 | Bice | 42/95 |
| 5,056,946 | A | * | 10/1991 | Larkin | 401/11 |
| 5,743,040 | A | | 4/1998 | Kennedy | 42/95 |
| 5,775,020 | A | | 7/1998 | Baird | 42/95 |

FOREIGN PATENT DOCUMENTS

| | | | | |
|---|---|---|---|---|
| GB | 261412 | * | 1/1927 | 42/95 |

* cited by examiner

*Primary Examiner*—Stephen M. Johnson
(74) *Attorney, Agent, or Firm*—Michalik & Wylie, PLLC

(57) ABSTRACT

An elongate bore cleaner, such as would be used to clean the inside of a barrel of a gun. The cleaner includes an elongate member, such as a hollow rod, that has a handle at one end and a cleaning member at the other. The handle is rotatably mounted relative to the cleaning member so that the cleaning member can rotate to fully engage the riflings in a gun barrel. The elongate bore cleaner also includes a fluid dispenser, preferably located adjacent the rear portion of the handle, the actuation of which causes fluid to flow through a conduit and out of apertures that are adjacent the cleaning member. Preferably, the fluid dispenser is a squeeze bottle, and the hollow rod serves as the conduit. Squeezing the squeeze bottle causes the cleaning fluid to travel from the squeeze bottle, through the hollow rod, exiting near the end of the rod, adjacent to the cleaning brush.

52 Claims, 4 Drawing Sheets

CLEANER FOR ELONGATE BORES

FIELD OF THE INVENTION

The present invention generally relates to cleaners, and more particularly to a cleaner for an elongate bore such as the barrel of a rifle.

BACKGROUND OF THE INVENTION

The inside of a gun barrel is cleaned periodically to remove the buildup of oxidation material, combustion residue and galling (metal to metal contact) by-products. To begin cleaning, the barrel may or may not be removed from the rails or support that hold the barrel in contact with the grip or stock of the gun. A cleaning cloth, brush, or the like is pushed and/or pulled through the bore. A cleaning fluid, such as a solvent, is typically used to enhance the removal of the buildup.

A gun barrel can be cleaned, for example, by stuffing and extracting a cleaning-fluid-soaked brush into the bore of the barrel. U.S. Pat. No. 4,674,218 to Bottomley discloses a gun-cleaning device having a rod with a brush on one end. The rod is rotatably mounted in the handle. Grasping the handle and inserting the brush in a forward motion into a gun barrel causes the brush to engage the rifling of the barrel, which in turn causes the rod and the brush to rotate. This free rotation of the brush provides the best engagement of the brush with the riflings, and thus optimal cleaning of the riflings.

However, the use of a rifle cleaner such as is disclosed in Bottomley can be messy. The brush for such cleaners is typically dipped into a cleaning fluid, inserted into the bore of the barrel, rotated by and then removed from the barrel, thereby removing or loosening the various grit and dirt items within the barrel. Dipping the brush into a separate container of cleaning solvent can be a messy process, often resulting in spillage and fouling of the environment. There is a need for a more efficient, and less messy, device for cleaning the inside of a rifle barrel. Preferably, the device would still provide rotation of the brush or cleaning number so that the riflings in the barrel can be optimally cleaned.

SUMMARY OF THE INVENTION

The present invention is directed to a cleaner for elongate bores, such as would be used to clean the inside of a barrel of a gun. The cleaner includes an elongate member, such as a hollow rod, that has a handle at one end and a cleaning member at the other. The handle is rotatably mounted relative to the cleaning member so that the cleaning member can rotate to maintain engagement with the riflings in a gun barrel. In use, an individual grasps the handle and thrusts the cleaning member into a rifle barrel. The rotatable mounting of the cleaning member relative to the handle allows the cleaning member to spin, for example when the cleaning member engages the rifling on the inside of the rifle barrel.

The elongate bore cleaner also includes a fluid dispenser, preferably located adjacent the rear portion of the handle, the actuation of which causes fluid to flow through a conduit and out of apertures that are adjacent the cleaning member. Preferably, the fluid dispenser is a squeeze bottle, and the hollow rod serves as the conduit. Squeezing the squeeze bottle causes the cleaning fluid to travel from the squeeze bottle, through the hollow rod, exiting near the end of the rod, adjacent to the cleaning brush.

The present invention provides both rotary cleaning and dispensing of a fluid within a barrel, in an easy-to-assemble cleaner. The design of the present invention requires little labor and minimal parts. Bearings, glue, and conventional fasteners are not required in assembly.

Other advantages will become apparent from the following detailed description when taken in conjunction with the drawings, in which:

DETAILED DESCRIPTION

Figure 1:
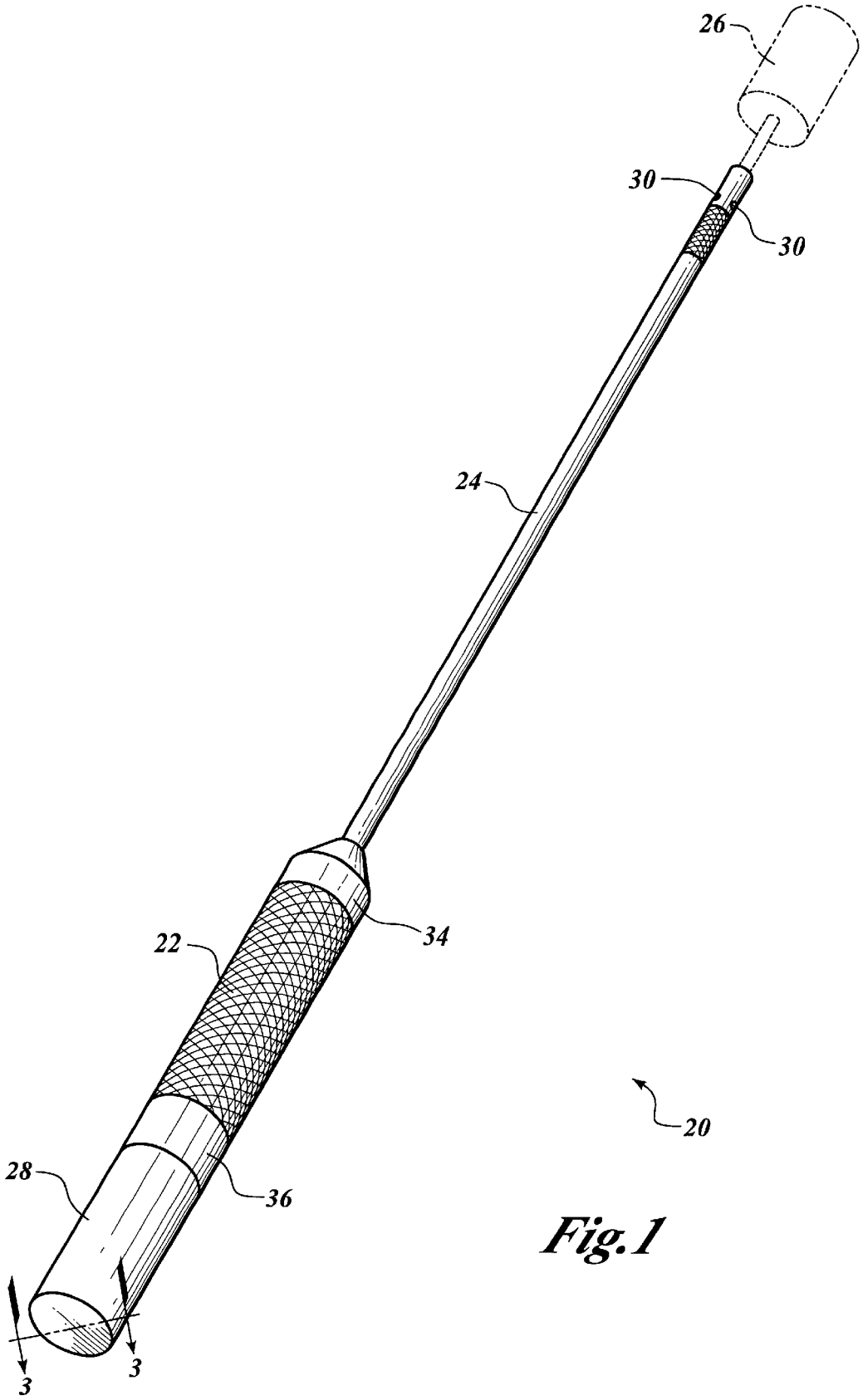
FIG. 1 is a perspective view of a rifle cleaner embodying the present invention.

Referring now to the drawings, in which like reference numerals represent like parts throughout the several views, FIG. 1 shows an elongate bore cleaner 20 in accordance with the present invention. The elongate bore cleaner 20 shown in the drawings is designed and configured for cleaning of the bore of a rifle barrel. However, the elongate bore cleaner 20 of the present invention can be designed and configured for the cleaning of any elongate bore, such as the inside of a pipe, for example. The bore could have any shape, including, but not limited to, a circular cross section, square cross section, or a cross section which is inconsistent along its length.

Briefly described, the elongate bore cleaner 20 includes a handle 22 connected by an elongate member (such as a hollow rod 24) to a cleaning member (such as a brush 26). A fluid dispenser (such as a squeeze bottle 28) is located at the distal end of the handle 22. The handle 22 is rotatably mounted relative to the brush 26, so that the brush, the hollow rod 24, and the squeeze bottle 28 freely rotate when a user holds the handle stationary. While holding the handle 22, a user thrusts the brush 26 into a gun barrel (not shown) and the rifling within the barrel rotates the brush. Squeezing the squeeze bottle 28 permits a cleaning fluid (not shown) to run along the hollow rod 24 and out of apertures 30 at the end of the hollow rod, so that the cleaning fluid can be applied when the brush is within the barrel bore, with minimal soiling or mess.

Figure 2:
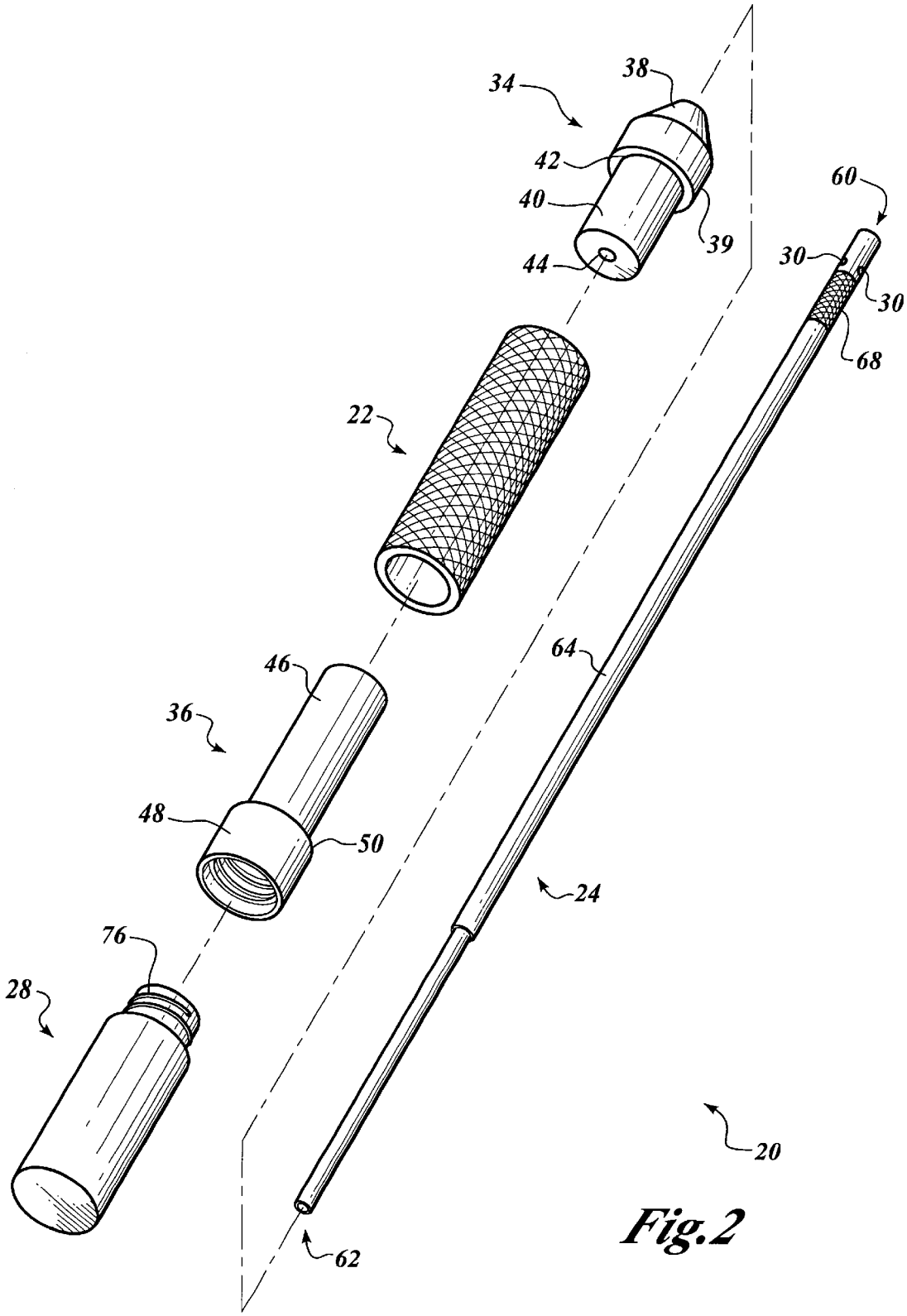
FIG. 2 is an exploded perspective view of the rifle cleaner of FIG. 1.
Figure 3:
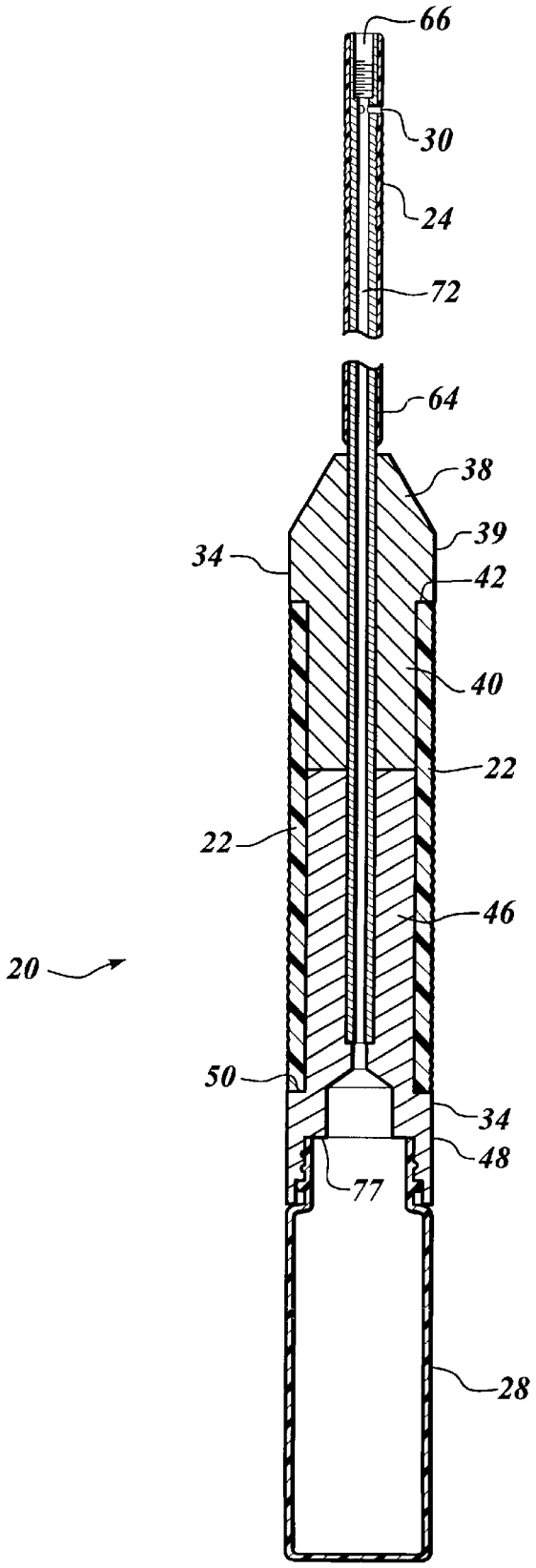
FIG. 3 is a sectional view taken along the section lines 3—3 of FIG. 1.

Turning now to a description of the invention in more detail, FIG. 2 displays an exploded perspective view of the components of the elongate bore cleaner 20. As can be seen in that drawing and in FIG. 3, the handle 22 is hollow and cylindrical, and includes an outer knurled surface 32 to enhance gripping. The handle 22 is preferably made of brushed aluminum, but could be made of many other materials, such as plastic, other metals such as steel, wood, or the like.

The handle 22 is mounted on an inner handle structure that includes a front nosepiece 34 and a tailpiece 36. The front nosepiece 34 includes a frustoconical front end 38 that tapers outward to a central cylindrical portion 39. A reduced-diameter back cylindrical portion 40 extends rearwardly from the central cylindrical portion 39. The reduced-diameter back cylindrical portion 40 has an outer diameter that is slightly less than the inner diameter of the handle 22. An abrupt shoulder 42 is formed at the intersection of the central flat portion 39 and the reduced-diameter back portion 40. The front nosepiece 34 includes a bore 44 that extends longitudinally along its length and through its longitudinal axis.

The tailpiece 36 includes a forward cylindrical extension 46 attached to a larger diameter, cylindrical rear portion 48. An abrupt shoulder 50 is formed at the intersection of the forward cylindrical extension 46 and the cylindrical rear portion 48. The rear end of the cylindrical rear portion 48 includes internal threads 52. A bore 54 extends longitudinally along the length of the tailpiece 36 and through its longitudinal axis.

The front nosepiece 34 and the tailpiece 36 are each preferably formed as a single piece out of a low friction material such as polyethylene or polyvinyl chloride (PVC). Polyethylene is an exemplary material because of its tolerance to solvents. However, the front nosepiece 34 and the tailpiece 36 could be formed of various other materials, such as metal, wood, or other plastics, for example.

The hollow rod 24 is preferably hollow metal tubing such as steel or aluminum, and could be any elongate member formed of a variety of different materials, including plastic or wood. The hollow rod 24 includes a cleaning member end 60 and a handle end 62. A portion of the handle end 62 is designed to extend into the inner handle structure, as is described further below. The remainder of the hollow rod 24 is covered by a nylon cover or film 64 (best shown in FIG. 2). The nylon film protects a bore from scratching during cleaning.

As described above, the hollow rod 24 includes apertures 30 at the cleaning member end 60. Female threads 66 are located just beyond the apertures 30 for the receipt of male threads (not shown) on the brush 26 or any other cleaning member. The female threads 66 serve as a cleaning member attachment, but any other type of attachment could be provided so that different cleaning members, such as swabs, jags, cleaning pads, and pieces of cloth, for example, could be attached to the hollow rod 24. A knurl ring 68 is located adjacent to the female threads 66, and provides a gripping surface for attachment of the brush 26 or another cleaning member.

A bore 72 extends along the length of the hollow rod 24, along its longitudinal center. Preferably, the hollow rod 24 is capped at the cleaning member end 60 just beyond the apertures 30. In practice, cleaning fluid from the fluid dispenser or squeeze bottle 28 travels along the bore 72 to and out the apertures 30. The capped end of the hollow rod 24 prevents the cleaning fluid from flowing out of the end of the hollow rod 24.

The squeeze bottle 28 is preferably formed of a flexible, resilient material, so that a user can pinch the squeeze bottle with, for example, a thumb and forefinger, to cause fluid in the squeeze bottle to flow upward into the hollow rod 24 and out of the apertures 30. The material for the squeeze bottle 28 is preferably resilient so that it has an ability and bias to return to its original shape after the application of force. One material that has been found to be suitable for construction of the squeeze bottle 28 is high density polyethylene (HDPE), but other materials could be used.

The squeeze bottle 28 includes male threads 76 at one end that are designed to match the female threads 52 on the tailpiece 36. A shoulder 77 (FIG. 3) is provided within the tailpiece 36 so that the squeeze bottle 28 is tightly seated after being screwed into the male threads 76, so that leaking is avoided.

To assemble the elongate bore cleaner 20, the handle 22 is placed over the reduced-diameter back portion 40 of the nosepiece 34 and the forward extension 46 of the tailpiece 36. The reduced-diameter back portion 40 of the nose piece 34 and the forward extension 46 of the tail piece 36 abut one another within the handle 22, leaving very small gaps (e.g., 0.020 in.) between the ends of the handle 22 and the shoulders 42, 50.

The handle end 62 of the rod 24 is then press fit into and through the bores 44, 54 in the nosepiece 34 and tailpiece 36. The bores 44, 54 are dimensioned so that they fit tightly on the handle end 62 of the hollow rod 24 and, after press fitting, cannot be moved relative to the hollow rod without considerable effort. The handle 22 is captured between the shoulders 42, 50 on the nosepiece 34 and tailpiece 36, respectively, and is seated on the reduced-diameter back portion 40 and the forward extension 46. The inner surface of the handle 22 and the outer surfaces of the reduced-diameter back portion 40 and the forward extension 46 are dimensioned so that the handle is free to rotate relative to the reduced-diameter back portion 40 and the forward extension 46. As described earlier, the surfaces of the reduced-diameter back portion 40 and the forward extension 46 are preferably formed with low friction material, which provides unimpeded rotation of the handle 22 on the inner handle structure.

To finish construction, the squeeze bottle 28 is filled with cleaning fluid and is threaded into the inner threads 52 in the tailpiece 36 until it is tightly seated against the shoulders 77. The brush 26 is threaded into the female threads 66, and the elongate bore cleaner 20 is ready to clean a rifle barrel or another bore, as appropriate.

The bore 72 of the hollow rod 24 serves as a conduit for the flow of fluid from the squeeze bottle 28 to the apertures 30. The bore 72 is preferably dimensioned so that surface tension of the fluid within the bore is sufficient to prevent drainage or dripping of the fluid when force is not applied to the squeeze bottle 28. However, the squeeze bottle 28 and the bore 72 are preferably configured and sized so that the surface tension can be overcome to provide flow of the fluid when the squeeze bottle 28 is gently squeezed by the thumb and forefinger of a user. Applicants have found that an inside bore diameter of 0.080 in. is sufficient in this regard for most solvent cleaning fluids.

Figure 4:
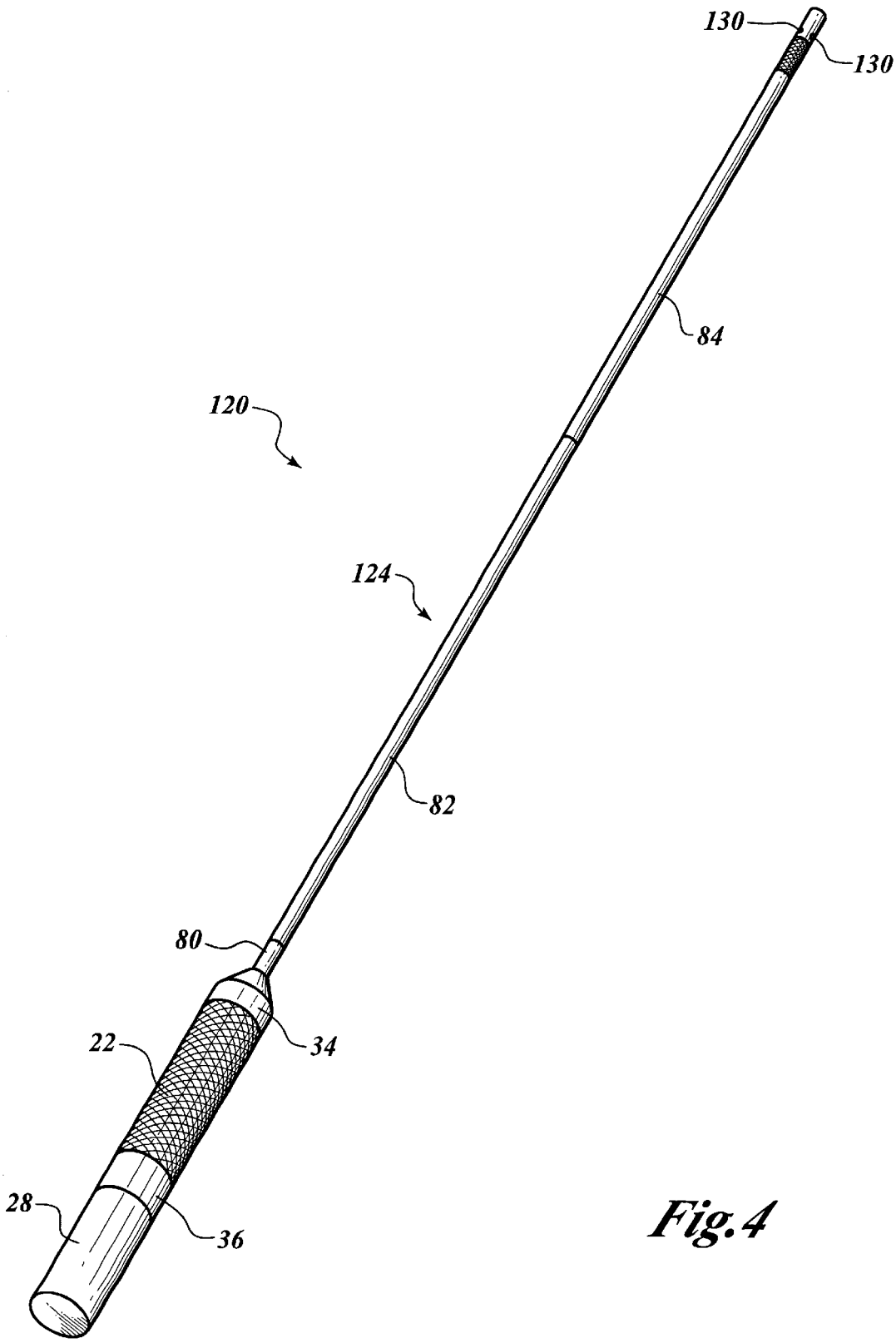
FIG. 4 is an alternate embodiment of a rifle cleaner embodying the present invention.

In an alternate embodiment of an elongate bore cleaner 120 shown in FIG. 4, a number of rod segments 80, 82, and 84 form the hollow rod 124. A first segment 80 is seated in the inner handle structure and extends slightly outside the end of the nosepiece 34. A third segment 84 includes the apertures 130, and a second segment 82 extends between the first and third segments. The second and third segments 82, 84 can be removed for easy storage. In addition, the second, central segment 82 could be eliminated for cleaning of the inside of a shorter barrel, such as for cleaning the inside of the barrel of a pistol. Alternatively, additional segments could be added so as to clean the bore of a longer barrel.

As can be appreciated from above description, the present invention provides an easy-to-assemble and inexpensive-to-manufacture rifle barrel cleaner that provides efficient cleaning of a rifle barrel with minimal mess. Because the handle 22 is free to rotate relative to the brush 26, the brush can rotate with the riflings within a gun barrel as the brush is thrust into and pulled out of the barrel. A user holds the handle 22 and the brush 26 is thrust into a rifle barrel. The brush 26, the hollow rod 24, the inner handle structure (the nose piece 34 and the tail piece 36), and the squeeze bottle 28 are rotated by the brush's engagement with the riflings. The surface tension within the hollow rod 24 prevents fluid from flowing out of the apertures 30. The user's application of pressure on the squeeze bottle 28 causes the fluid to flow through the hollow rod 24 and out of the apertures 30, and into the barrel of the rifle.

The simplicity of the construction of the described embodiment provides many advantages. For example, the device is easy to use, inexpensive to manufacture, and requires minimal parts and labor to produce. Alternate embodiments are also contemplated. For example, as one alternative, the brush 26 could spin relative to the hollow rod 24, and the handle 22 could be fixed relative to the hollow rod. In addition, the hollow rod 24 could be replaced with a solid rod, and a conduit for supplying fluid from the squeeze bottle 28 or another fluid dispenser could be provided by a tube that extends down the solid rod. The fluid dispenser, on the other hand, could be located on the forward portion of the handle, or within the handle, or even separately of the handle, and could be actuated by a number of mechanisms, such as a trigger, a gaseous cartridge, a plunger or piston arrangement (such as a syringe), or other mechanisms that work either manually or automatically. The teachings of the present invention can also be used with a rifle cleaner that is automatically driven into and out of the rifle barrel.

Moreover, although the above embodiment of the invention is described with respect to the cleaning of rifles and dispensing of a cleaning fluid, the present invention could be used for the cleaning of a number of different types of bores. In addition, the fluid dispenser of the present invention could be used to dispense a number of different fluids, such as, for example, a lubricant. In that manner, the cleaning member would be a fluid carrier or spreader, which serves to apply the fluid to the inside of the bore being cleaned.

Other alternatives are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. An elongate bore cleaner, comprising:

a handle;

an elongate member extending from the handle;

a cleaning member mounted on the elongate member and capable of spinning rotation relative to the handle, the spinning rotation being independent of attachment of the cleaning member to the elongate member;

a fluid dispenser; and a conduit extending from the fluid dispenser to adjacent the cleaning member;

wherein actuation of the fluid dispenser causes fluid in the fluid dispenser to flow from the fluid dispenser, through the conduit, and out of the conduit and out of the elongate bore cleaner adjacent to the cleaning member while the cleaning member is capable of the spinning rotation relative to the handle.

2. The elongate bore cleaner of claim 1, wherein the elongate member rotates with the cleaning member.

3. The elongate bore cleaner of claim 2, wherein the conduit extends through the handle and the fluid dispenser is located on the opposite side of the handle from the cleaning member.

4. The elongate bore cleaner of claim 3, wherein the elongate member comprises a hollow rod, and wherein the conduit comprises the inside of the hollow rod.

5. The elongate bore cleaner of claim 3, wherein the fluid dispenser rotates with the cleaning member.

6. The elongate bore cleaner of claim 5, wherein the conduit extends through the handle and the fluid dispenser is located on the opposite side of the handle from the cleaning member.

7. The elongate bore cleaner of claim 6, wherein the elongate member comprises a hollow rod, and wherein the conduit comprises the inside of the hollow rod.

8. The elongate bore cleaner of claim 2, wherein the fluid dispenser rotates with the cleaning member.

9. The elongate bore cleaner of claim 1, further comprising an inner handle structure connected to the elongate member and upon which the handle rotates.

10. The elongate bore cleaner of claim 9, wherein the fluid dispenser is connected to the inner handle structure.

11. The elongate bore cleaner of claim 10, wherein the fluid dispenser is located on the opposite side of the handle from the cleaning member.

12. The elongate bore cleaner of claim 10, wherein the fluid dispenser comprises a squeeze bottle, and wherein actuating the fluid dispenser comprises squeezing the squeeze bottle.

13. The elongate bore cleaner of claim 9, wherein the elongate member extends into the inner handle structure.

14. The elongate bore cleaner of claim 13, wherein the inner handle structure comprises:

a nose piece on a side of the handle closest to the cleaning member and mounted on the elongate member; and a tail piece on the side of the handle opposite the cleaning member and mounted on the elongate member.

15. The elongate bore cleaner of claim 14, wherein the handle is rotatable mounted on the nosepiece and the tailpiece.

16. The elongate bore cleaner of claim 15, wherein the nose piece and the tail piece each comprise a shoulder, and wherein the handle is confined between the respective shoulders.

17. The elongate bore cleaner of claim 14, wherein the fluid dispenser is mounted to the tailpiece.

18. The elongate bore cleaner of claim 17, wherein the fluid dispenser comprises a squeeze bottle, and wherein actuating the fluid dispenser comprises squeezing the squeeze bottle.

19. The elongate bore cleaner of claim 17, wherein the conduit extends through the nosepiece and the tailpiece.

20. The elongate bore cleaner of claim 19, wherein the elongate member comprises a hollow rod, and wherein the conduit comprises the inside of the hollow rod.

21. The elongate bore cleaner of claim 20, further comprising apertures in the hollow rod and adjacent the cleaning member, and wherein the fluid flows out of the apertures upon actuation of the fluid dispenser.

22. The elongate bore cleaner of claim 1, wherein the elongate member comprises a hollow rod, and wherein the conduit comprises the inside of the hollow rod, and further comprising apertures in the hollow rod and adjacent the cleaning member, and wherein the fluid flows out of the apertures upon actuation of the fluid dispenser.

23. The elongate bore cleaner of claim 1, wherein the elongate member comprises a plurality of elongate hollow rods connected end-to-end.

24. The elongate bore cleaner of claim 23, further comprising at least one additional hollow rod so that the cleaning member is capable of extending into a longer elongate bore.

25. The elongate bore cleaner of claim 1, wherein the conduit is configured such that surface tension of the fluid in the conduit is sufficient to substantially prevent flow of fluid out of the conduit absent actuation of the fluid dispenser.

26. An elongate bore cleaner, comprising:

an inner handle structure having first and second ends;

a handle mounted for free, continuous rotation relative to the inner handle structure;

an elongate member extending out of the first end of the inner handle structure;

a cleaning member mounted on the elongate member;

at least one aperture on the elongate member adjacent the cleaning member;

a fluid dispenser attached to the second end of the inner handle structure; and a conduit extending from the fluid dispenser, through the handle, along the elongate member, to the at least one aperture;

wherein actuation of the fluid dispenser causes a fluid in the fluid dispenser to flow though the conduit and out the at least one aperture and out of the elongate bore cleaner while the cleaning member is capable of the spinning rotation relative to the handle, the spinning rotation being independent of attachment of the cleaning member to the elongate member.

27. An elongate bore cleaner, comprising:

a handle;

an elongate member extending from the handle;

a cleaning member holder mounted on the elongate member and configured to receive a cleaning member, the cleaning member holder being capable of spinning rotation relative to the handle, the spinning rotation being independent of attachment of the cleaning member to the elongate member;

a fluid dispenser; and a conduit extending from the fluid dispenser to adjacent the cleaning member holder;

wherein actuation of the fluid dispenser causes fluid in the fluid dispenser to flow from the fluid dispenser, through the conduit, and out of the conduit and out of the elongate bore cleaner adjacent to the cleaning member holder while the cleaning member holder is capable of the spinning rotation relative to the handle.

28. The elongate bore cleaner of claim 27, wherein the elongate member rotates with the cleaning member holder.

29. The elongate bore cleaner of claim 28, wherein the conduit extends through the handle and the fluid dispenser is located on the opposite side of the handle from the cleaning member holder.

30. The elongate bore cleaner of claim 29, wherein the elongate member comprises a hollow rod, and wherein the conduit comprises the inside of the hollow rod.

31. The elongate bore cleaner of claim 29, wherein the fluid dispenser rotates with the cleaning member holder.

32. The elongate bore cleaner of claim 31, wherein the conduit extends through the handle and the fluid dispenser is located on the opposite side of the handle from the cleaning member holder.

33. The elongate bore cleaner of claim 32, wherein the elongate member comprises a hollow rod, and wherein the conduit comprises the inside of the hollow rod.

34. The elongate bore cleaner of claim 28, wherein the fluid dispenser rotates with the cleaning member holder.

35. The elongate bore cleaner of claim 27, further comprising an inner handle structure connected to the elongate member and upon which the handle rotates.

36. The elongate bore cleaner of claim 35, wherein the fluid dispenser is connected to the inner handle structure.

37. The elongate bore cleaner of claim 36, wherein the fluid dispenser is located on the opposite side of the handle from the cleaning member holder.

38. The elongate bore cleaner of claim 36, wherein the fluid dispenser comprises a squeeze bottle.

39. The elongate bore cleaner of claim 35, wherein the elongate member extends into the inner handle structure.

40. The elongate bore cleaner of claim 39, wherein the inner handle structure comprises:

a nose piece on a side of the handle closest to the cleaning member holder and is mounted on the elongate member; and a tail piece on the side of the handle opposite the cleaning member holder and mounted on the elongate member.

41. The elongate bore cleaner of claim 40, wherein the handle is rotatably mounted on the nosepiece and the tailpiece.

42. The elongate bore cleaner of claim 41, wherein the nose piece and the tail piece each comprise a shoulder, and wherein the handle is confined between the respective shoulders.

43. The elongate bore cleaner of claim 40, wherein the fluid dispenser is mounted to the tailpiece.

44. The elongate bore cleaner of claim 43, wherein the fluid dispenser comprises a squeeze bottle, and wherein actuating the fluid dispenser comprises squeezing the squeeze bottle.

45. The elongate bore cleaner of claim 43, wherein the conduit extends through the nosepiece and the tailpiece.

46. The elongate bore cleaner of claim 45, wherein the elongate member comprises a hollow rod, and wherein the conduit comprises the inside of the hollow rod.

47. The elongate bore cleaner of claim 46, further comprising apertures in the hollow rod and adjacent the cleaning member holder, and wherein the fluid flows out of the apertures upon actuation of the fluid dispenser.

48. The elongate bore cleaner of claim 27, wherein the elongate member comprises a hollow rod, and wherein the conduit comprises the inside of the hollow rod, and further comprising apertures in the hollow rod and adjacent the cleaning member holder, and wherein the fluid flows out of the apertures upon actuation of the fluid dispenser.

49. The elongate bore cleaner of claim 27, wherein the elongate member comprises a plurality of elongate hollow rods connected end-to-end.

50. The elongate bore cleaner of claim 49, further comprising at least one additional hollow rod so that the cleaning member holder is capable of extending further into an elongate bore.

51. The elongate bore cleaner of claim 27, wherein the conduit is configured such that surface tension of the fluid in the conduit is sufficient to substantially prevent flow of fluid out of the conduit absent actuation of the fluid dispenser.

52. An elongate bore cleaner, comprising:

an inner handle structure having first and second ends;

a handle rotatably mounted on the inner handle structure;

an elongate member extending out of the first end of the inner handle structure and fixed for rotation with the inner handle, the spinning rotation being independent of attachment of the cleaning member to the elongate member;

a cleaning member holding mounted on the elongate member and configured to receive a cleaning member, the cleaning member holder being capable of spinning rotation relative to the handle;

at least one aperture on the elongate member adjacent the cleaning member holder;

a fluid dispenser attached to the second end of the inner handle structure; and a conduit extending from the fluid dispenser, through the handle along the elongate member, to the at least one aperture;

whereby a fluid in the dispenser can be supplied though the conduit and out the at least one aperture and out of the elongate bore cleaner while the cleaning member holder is capable of the spinning rotation relative to the handle.

* * * * *